US011846145B2

(12) United States Patent
Wiedmer

(10) Patent No.: US 11,846,145 B2
(45) Date of Patent: Dec. 19, 2023

(54) LOCKING CLAMP AND TUBULAR ELEVATOR ASSEMBLY

(71) Applicant: Gregory Wiedmer, Kenmare, ND (US)

(72) Inventor: Gregory Wiedmer, Kenmare, ND (US)

( * ) Notice: Subject to any disclaimer, the term of this patent is extended or adjusted under 35 U.S.C. 154(b) by 0 days.

(21) Appl. No.: 17/723,544

(22) Filed: Apr. 19, 2022

(65) Prior Publication Data

US 2022/0333448 A1 Oct. 20, 2022

Related U.S. Application Data

(60) Provisional application No. 63/176,780, filed on Apr. 19, 2021.

(51) Int. Cl.
*E21B 19/06* (2006.01)

(52) U.S. Cl.
CPC ..... *E21B 19/06* (2013.01)

(58) Field of Classification Search
CPC ..... E21B 19/06
See application file for complete search history.

(56) References Cited

U.S. PATENT DOCUMENTS

| | | | | |
|---|---|---|---|---|
| 2,067,663 | A | 1/1937 | Grau | |
| 2,567,044 | A | 9/1951 | Wilson | |
| 2,957,724 | A | 10/1960 | Bujold | |
| 3,884,519 | A | 5/1975 | McFadden | |
| 4,336,637 | A | 6/1982 | Patterson | |
| 4,567,740 | A | 2/1986 | Kelly | |
| 4,579,379 | A | 4/1986 | Berg | |
| 5,340,182 | A | 8/1994 | Busink et al. | |
| 7,434,614 | B2 | 10/2008 | Nelson et al. | |
| 8,313,128 | B2 | 11/2012 | Belyea et al. | |
| 8,979,150 | B1 | 3/2015 | McKissack | |
| 9,109,409 | B2 | 8/2015 | Childress, II et al. | |
| 9,121,243 | B1 | 9/2015 | Headifen | |
| 9,517,548 | B2 * | 12/2016 | Van Valkenburg | B25B 5/04 |
| 2016/0090795 | A1 * | 3/2016 | Haas | E21B 19/06 24/456 |

FOREIGN PATENT DOCUMENTS

| | | | | |
|---|---|---|---|---|
| CA | 2957022 | C * | 10/2020 | E21B 19/07 |
| KR | 20190048548 | A | 5/2019 | |
| KR | 20190048555 | A | 5/2019 | |
| PL | 133219 | B1 | 5/1985 | |
| RU | 2107146 | C1 | 3/1998 | |

* cited by examiner

*Primary Examiner* — Aaron L Lembo
(74) *Attorney, Agent, or Firm* — John Rizvi; John Rizvi, P.A.—The Patent Professor®

(57) ABSTRACT

A locking clamp assembly is provided, which can be expeditiously deployed on a drill pipe elevator or other tubular elevator, to secure the tubular elevator in a closed position around a tubular element, and can be rapidly removed to disconnect the tubular elevator from the tubular element. The locking clamp assembly includes a locking clamp having a main body defining a clamp space, which is sized and shaped to receive a pair of structural elements on respective jaws of the tubular elevator when the tubular elevator is in the closed position with the jaws of the tubular elevator extending around the tubular element. A clamp fastener may be secured to the main body to retain the structural elements within the clamp space. A tether may connect the main body to the tubular elevator.

19 Claims, 6 Drawing Sheets

LOCKING CLAMP AND TUBULAR ELEVATOR ASSEMBLY

CROSS-REFERENCE TO RELATED APPLICATION

The present application claims the benefit of U.S. Provisional Patent Application No. 63/176,780, filed on Apr. 19, 2021, which is incorporated herein by reference in its entirety.

FIELD OF THE INVENTION

The present invention relates generally to tubular elevators, and more particularly, to a locking clamp assembly which can be expeditiously deployed on a tubular elevator, to secure the tubular elevator in a closed position, and removed to open the tubular elevator.

BACKGROUND OF THE INVENTION

In the drilling of hydrocarbon (oil and gas) wells, a drill pipe, also referred to as drilling pipe, drilling string, or drill string, may be rotated to cut and form a wellbore from the surface of the ground to the subterranean formation or formations from which the hydrocarbon will be produced. The end of the drill pipe may be fitted with a cutting head which dislodges the rock and other soil as the drill pipe forms the wellbore. Drilling fluid or "mud" may be simultaneously ejected from the cutting head into the wellbore to enhance the drilling action. The drilling fluid may subsequently be removed from the wellbore with the dislodged soil material by flowing the fluid and material upwardly around the drill pipe to the surface of the well.

The drill pipe may be progressively assembled by connecting drill pipe segments end-to-end as the drilling operation progresses. The drill pipe is rotated and advanced into the ground until another drill pipe segment is needed to extend the assembled length of the drill pipe. When addition of another drill pipe element is required, rotation of the drill pipe is stopped and the rotary table on the drilling rig is moved out of the way such that the additional drill pipe segment can be deployed in place and attached to the drill pipe. After formation of the wellbore is completed, the drill pipe may be disassembled in the reverse process as it is removed from the wellbore.

A drill pipe elevator is commonly used to hold the drill pipe in place during the drilling operation. A conventional drill pipe elevator may include a pair of curved gripping members that are hingedly coupled to each other to open and close in a clamshell manner. In the closed position, the members may define a center opening that accommodates the drill pipe.

A typically spring-loaded double safety latch may be used to prevent the gripping members from inadvertently opening during use. A secondary safety mechanism may be used to prevent the safety latch from inadvertently disengaging. The secondary safety mechanism may include a pin that may be inserted into pin openings in the primary safety latch to secure and lock the primary safety latch. Opening of the drill pipe elevator typically requires removal of the pin from the pin openings to disengage the primary safety latch and facilitate opening of the gripping members.

The conventional secondary safety mechanism for drill pipe elevators may require both hands to facilitate alignment of the pin openings and installation of the pin into the openings in the primary safety latch. This drawback may prolong the time needed to properly deploy and secure the primary safety latch. Moreover, the pin may require storage when not in use. In some cases, a tether may secure the pin to prevent loss of the pin when not in use. In the event that the tether is damaged, however, the pin may be lost. Additionally, the securing tether may potentially snag or otherwise injure an operator. In some cases, the latch may inadvertently disengage such that the drill pipe elevator loses its grip on the drill pipe, causing the drill pipe to fall into the wellbore due to gravity.

Accordingly, there is need for a solution to at least one of the aforementioned problems. For example, there is a need for a tubular-elevator-securing solution that can be expeditiously and safely deployed on a tubular elevator (e.g., a drill pipe elevator) to secure the tubular elevator in a closed position, and can be rapidly and safely removed from the tubular elevator to open the tubular elevator.

SUMMARY OF THE INVENTION

The present invention is directed to a locking clamp assembly which can be expeditiously deployed on a tubular elevator to secure the tubular elevator in a closed position and removed to open the tubular elevator.

In a first implementation, the locking clamp assembly may comprise a locking clamp. The locking clamp may include main body having a clamp space. The clamp space may be suitably sized and configured to receive a pair of structural elements on the respective jaws of a tubular elevator. In an exemplary application, the jaws of the tubular elevator may be deployed around a tubular element (e.g., a drill pipe, tubing, drill caller, or a segment thereof). The locking clamp assembly may be positioned such that the clamp space of the locking clamp may receive the structural elements on the respective jaws of the tubular elevator and secured in place. The jaws of the tubular elevator are thus securely locked in the closed position around the tubular element. The tubular elevator may be subsequently selectively unsecured and removed from the structural elements on the jaws of the tubular elevator to facilitate opening of the jaws and removal of the tubular elevator from the tubular element.

In another implementation, a locking clamp and tubular elevator assembly may include a tubular elevator and a locking clamp assembly. The tubular elevator may include a pair of jaws movable relative to one another between an open position and a closed position for receiving and retaining a tubular element, respectively. The tubular elevator may further include a pair of structural elements, each structural element extending from a respective jaw of the pair of jaws. The locking clamp assembly may include a locking clamp and at least one clamp fastener. The locking clamp may include a main body defining a clamp space. The one or more clamp fasteners are connectable to the locking clamp. The locking clamp and tubular elevator assembly are positionable in an assembled configuration, in which the pair of jaws are arranged in the closed position and the main body of the locking clamp is mounted on the pair of structural elements, with the pair of structural elements received within the clamp space. In the assembled configuration, the at least one clamp fastener may be connected to the locking clamp, with the clamp body and at least one clamp fastener retaining the pair of structural elements within the clamp space and further retaining the pair of jaws in the closed position.

In another aspect, each structural element of the pair of structural elements may include a respective head. In the assembled configuration, the main body of the locking clamp may be retained on the pair of structural elements and the pair of structural elements may be retained within the clamp space by the heads of the pair of structural elements.

In another aspect, the clamp space may be less wide than the heads of the pair of structural elements.

In another aspect, the main body may include a side portion, a first arm, and a second arm. The first and second arms may extend from the side portion in spaced-apart relationship with one another. The clamp space may be formed by and between the side portion and first and second arms.

In another aspect, in the assembled configuration, the first arm may be arranged below the pair of structural elements and the second arm may be arranged above the pair of structural elements.

In another aspect, a distance between the first and second arms may be generally equal to a thickness of a respective portion of each structural element of the pair of structural elements received between the first and second arms. In the assembled configuration, the first and second arms may abut against the respective portions of the pair of structural elements.

In another aspect, in the assembled configuration, the first arm may contact the respective portions of the pair of structural elements along respective first contact edges forming a first contact plane. The second arm may contact the respective portions of the pair of structural elements along respective second contact edges forming a second contact plane.

In another aspect, the first and second arms may extend from opposite ends of the side portion of the main body.

In another aspect, the side portion and first and second arms may form a C-shaped arrangement comprising a closed end and an opposite, open end.

In another aspect, the at least one clamp fastener may include an end fastener securable to the main body. In the assembled configuration, the end fastener may be secured to the main body at or near the open end thereof, retaining the pair of structural elements within the clamp space.

In another aspect, in the assembled configuration, the pair of structural elements may abut against an inner side of the side portion facing the clamp space and further against the end fastener.

In another aspect, in the assembled configuration, the end fastener may extend from the first arm to the second arm.

In another aspect, each one of the first and second arms may include a respective fastener opening. The fastener openings of the first and second arms may be configured to receive the end fastener therethrough in a direction parallel to the side portion.

In another aspect, the locking clamp and tubular elevator assembly may further include at least one tether mountable to connect the locking clamp assembly to the tubular elevator. In the assembled configuration, the at least one tether may attach the locking clamp assembly to the tubular elevator.

In another aspect, in the assembled configuration, the at least one tether may be attached to the main body of the locking clamp of the locking clamp assembly.

In another aspect, the locking clamp and tubular elevator assembly may be alternatively and selectively positionable in a released configuration, in which the at least one clamp fastener may be at least partially disconnected from the locking clamp, and the pair of structural elements may be removed from the clamp space allowing the pair of jaws to move towards the open position. In the released configuration, the locking clamp assembly may be secured to the tubular elevator by the at least one tether.

In another aspect, in the assembled configuration, the at least one tether may be attached to a side portion of the main body, the side portion opposite to an open end of the main body through which the pair of structural elements may be insertable into and removable from the clamp space.

In another aspect, the at least one tether may be attached to a tether attachment surface of the main body. The tether attachment surface may be arranged opposite to the clamp space.

In another aspect, the clamp fastener may include a bolt and a securing nut.

In another aspect, the at least one tether may include a chain or cable.

In another aspect, each of the first arm and the second arm may have a square or rectangular cross-section.

In another aspect, the tubular elevator may include an elevator hinge pivotably connecting the jaws and a pair of elevator projections extending from the jaws, respectively, and the clamp space of the locking clamp may be sized and configured to accommodate the pair of elevator projections.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a locking clamp assembly which can be expeditiously deployed on a tubular elevator to secure the tubular elevator in a closed position and removed from the tubular elevator to open the tubular elevator.

Figure 1:
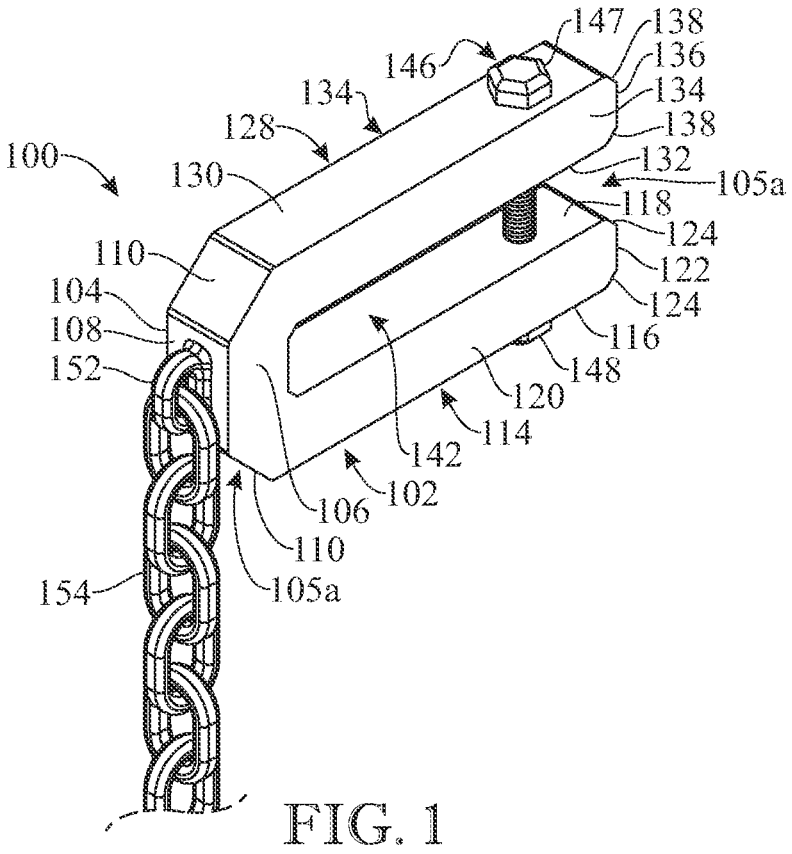
FIG. 1 presents a top, front left isometric view of a locking clamp assembly in accordance with an illustrative embodiment of the present invention, with a clamp fastener of the locking clamp assembly shown fastened to a main body of the assembly.
Figure 2:
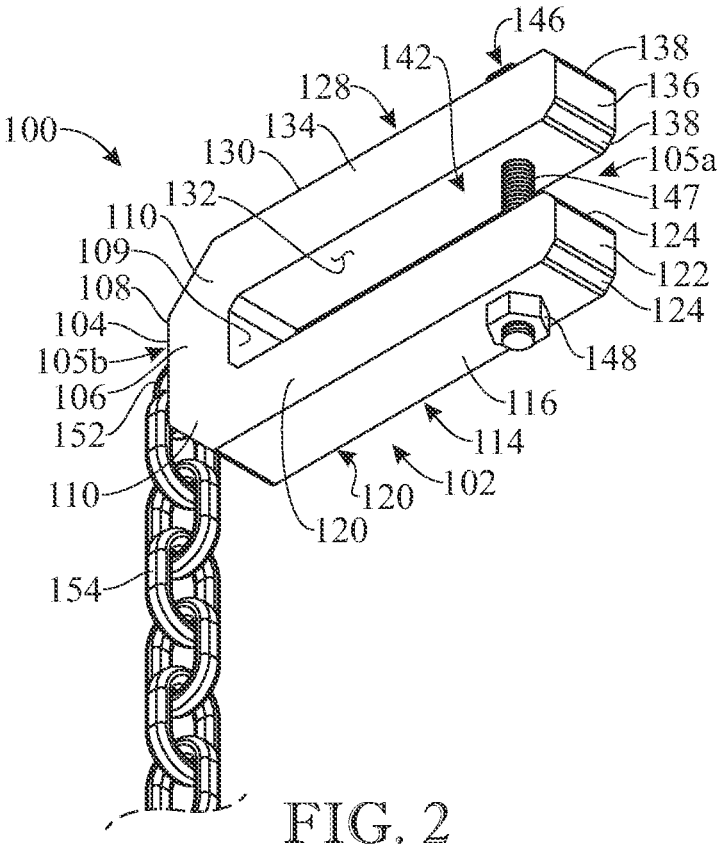
FIG. 2 presents a bottom, front right isometric view of the locking clamp assembly of FIG. 1.
Figure 3:
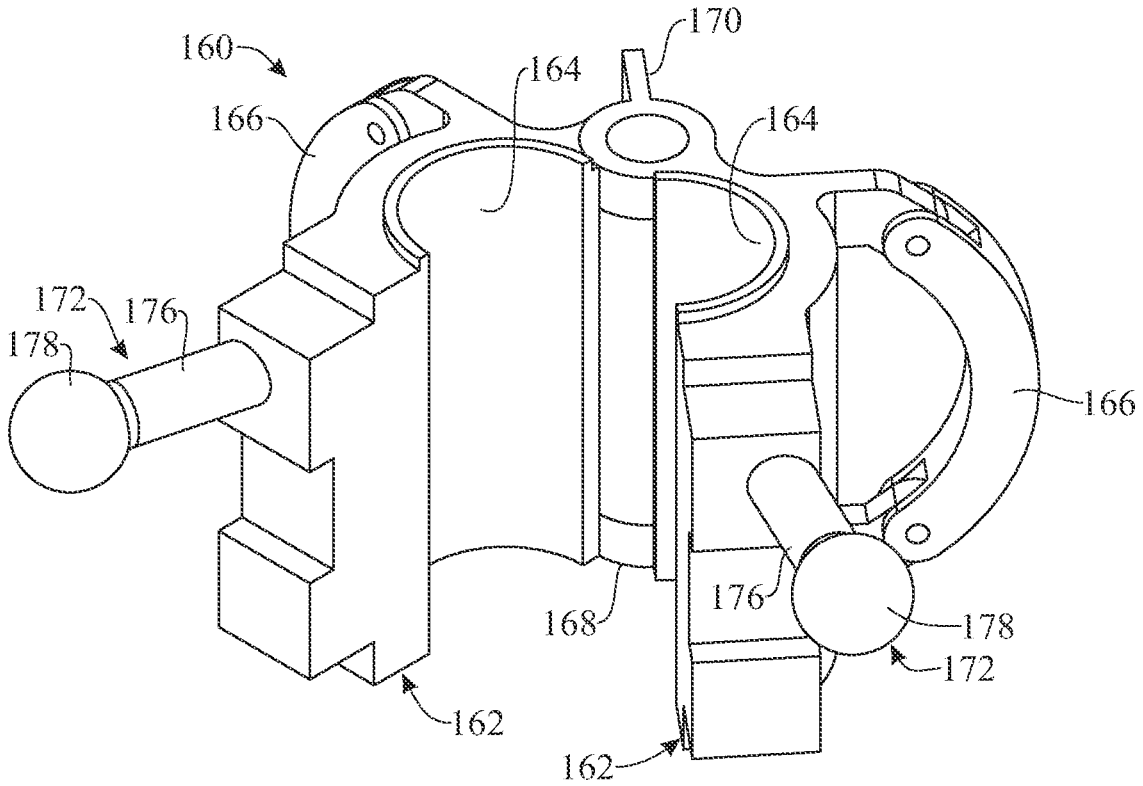
FIG. 3 presents a top, front isometric view of an example of tubular elevator which is securable using the locking clamp assembly of FIG. 1, with the tubular elevator illustrated in an open configuration.
Figure 4:
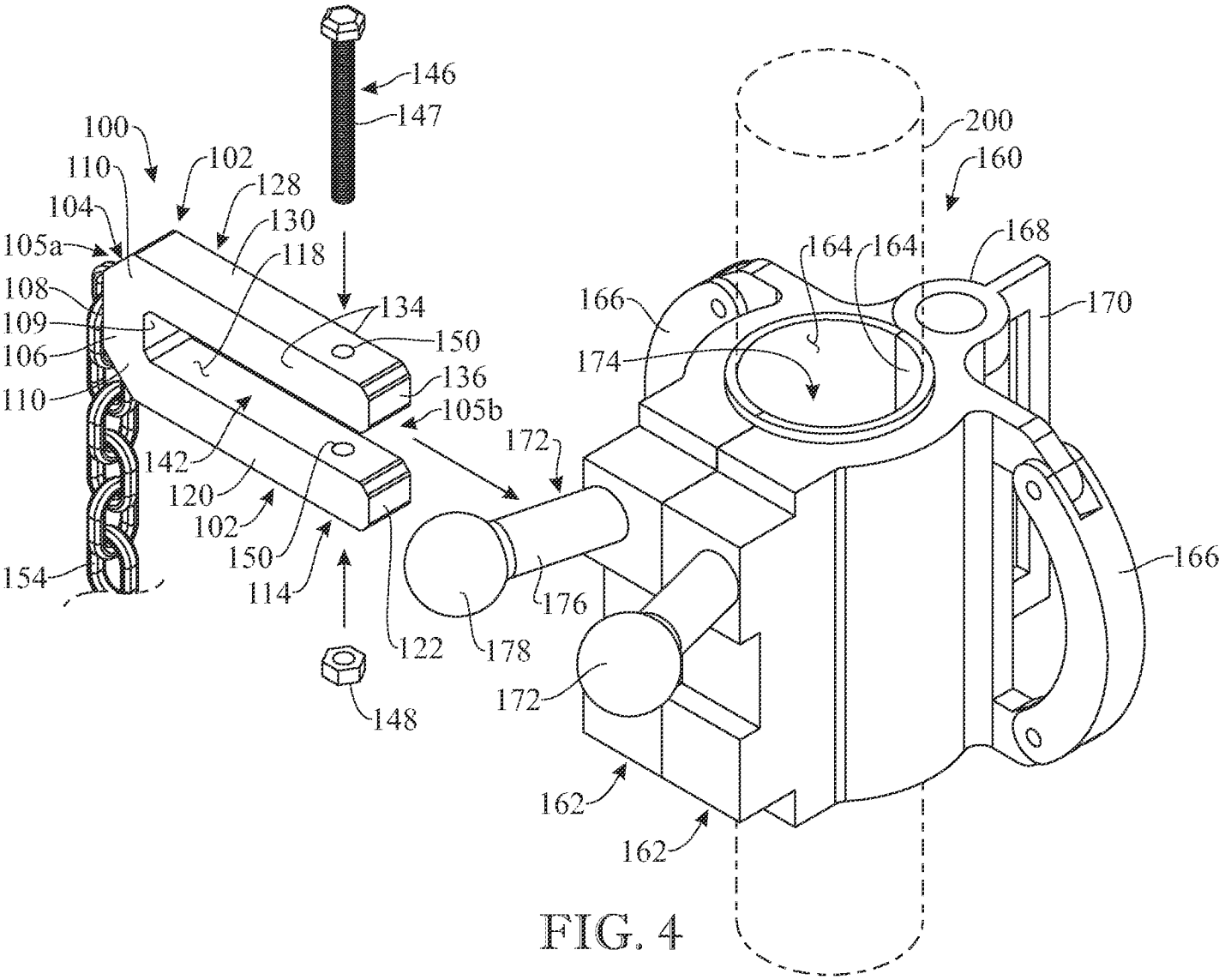
FIG. 4 presents a top, front isometric view of the locking clamp assembly of FIG. 1 and the tubular elevator of FIG. 3, shown in the closed configuration, the figure more particularly illustrating typical deployment of the locking clamp in place on the tubular elevator.

Shown throughout the figures is a locking clamp assembly 100 for a tubular elevator, in accordance with an illustrative embodiment of the invention. With reference initially to FIGS. 1 and 2, the locking clamp assembly 100 comprises a locking clamp 102 configured to clamp onto a tubular elevator, such as, but not limited to, a tubular elevator 160 as depicted in FIGS. 3 and 4. As shown in the figures, the tubular elevator 160 may include respective jaws 162 pivotably attached to one another by an elevator hinge 168, such that the jaws 162 are pivotable between an open position (FIG. 3) and a closed position (FIG. 4). In the closed position, the jaws 162 define a tubular element bore 174 configured to tightly receive a tubular element (e.g., tubular element 200 in FIG. 4) such that the jaws 162 can hold the tubular element. In the open position, the tubular element may be inserted into or removed from the tubular elevator 160. The locking clamp assembly 100 may be used in conjunction with tubular elevators configured to clamp and raise a wide variety of tubular elements, such as, but not limited to, a drill pipe, tubing, drill caller, etc., or segments thereof, of different makes, models, and sizes.

As further illustrated in FIGS. 3 and 4, each jaw 162 may have an elongated tubular element engaging surface 164. Each tubular element engaging surface 164 may have a concave cross-section. As illustrated in FIG. 4, in the closed configuration of the tubular elevator 160, the tubular element engaging surfaces 164 may cooperate to form the tubular element bore 174 through which the tubular element extends in application of the tubular elevator 160. The tubular element bore 174 may be laterally enclosed by the tubular element engaging surfaces 164, and may be open at top and bottom ends thereof to allow the tubular element to extend therethrough.

Figure 5:
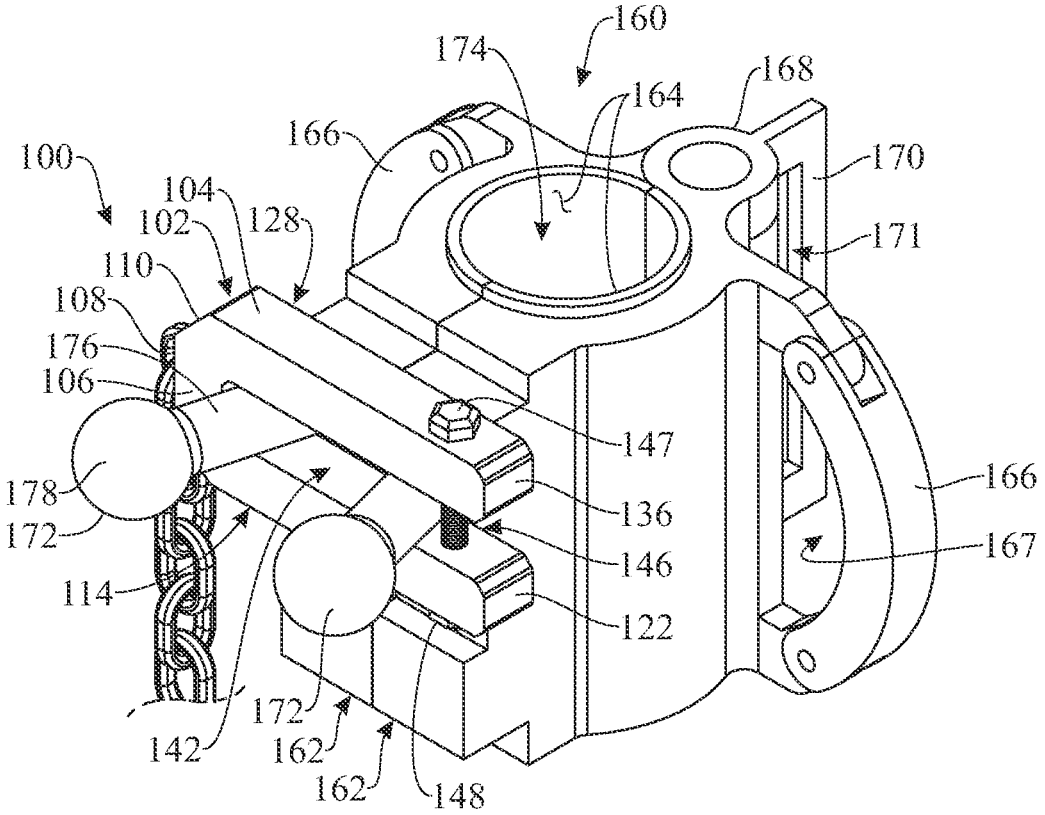
FIG. 5 presents a top, front isometric view of the locking clamp assembly and tubular elevator of FIG. 4, more particularly showing the locking clamp assembly deployed in place on the closed tubular elevator and the clamp fastener fastened to the main body, to secure the tubular elevator in the closed configuration.

The tubular elevator 160 may include one or more side arms 166 and/or rear arms 170, which may extend outward to facilitate hoisting of the tubular elevator 160 with the tubular element extending through the tubular elevator 160 and secured therein in typical application of the tubular elevator 160, for instance and without limitation. For example, the tubular elevator 160 shown herein includes a pair of opposite side arms 166 and a single rear arm 170, wherein each side arm 166 extends outward of and is carried by a respective one of the jaws 162 and the rear arm 170 extends from the elevator hinge 168. In some embodiments, one or more of the side arm(s) 166 and rear arm(s) 170 may form a D-ring or otherwise closed loop arrangement such that the arm defines and encloses an interior space. For example, as best shown in FIG. 5, top and bottom ends of each side arm 166 of the present embodiment extend from the respective clamp 162 such that each side arm 166 forms a respective, generally rounded D-ring, an interior space 167 being defined between the side arm 166 and the corresponding clamp 166; similarly, top and bottom ends of the rear arm 170 extend from the hinge 168, with the end arm 170 forming a generally rectangular D-ring and an interior space 171 being defined between the end arm 170 and the hinge 168.

With continued reference to FIGS. 3 and 4, each jaw 162 may include a respective structural element 172 which extends from the jaw 162. The structural elements 172 may provide connecting points when the jaws 162 are arranged in the closed position (FIG. 4). For instance, in the depicted example, each structural element 172 comprises an elongated arm 176, bar or rod, which may be terminated in a relatively wider end or head 178. When the jaws 162 are closed, the structural elements 172 may be arranged in side-by-side or adjacent relationship, spaced apart from one another, as shown in FIGS. 4-7. In different embodiments, the structural elements 172 may be arranged in non-parallel (as shown) or parallel relationship with each other.

With reference to FIGS. 1 and 2, the locking clamp 102 of the locking clamp assembly 100 may include a clamp space 142 that may be suitably sized and configured to receive the pair of structural elements 172 on the respective jaws 162 of the tubular elevator 160. In an exemplary application, the jaws 162 of the tubular elevator 160 may be deployed around a tubular element 200 (FIG. 4), and the locking clamp assembly 100 may be positioned such that the clamp space 142 of the locking clamp 102 receives the structural elements 170 on the respective jaws 162 of the tubular elevator 160 and the structural elements 170 are secured in place. The jaws 162 of the tubular elevator 160 may be thereby securely locked in the closed position around the tubular element. The tubular elevator 160 may be subsequently selectively unsecured and removed from the structural elements 172 on the jaws 162 of the tubular elevator 160 to facilitate opening of the jaws 162 and removal of the tubular elevator 160 from the tubular element.

Figure 7:
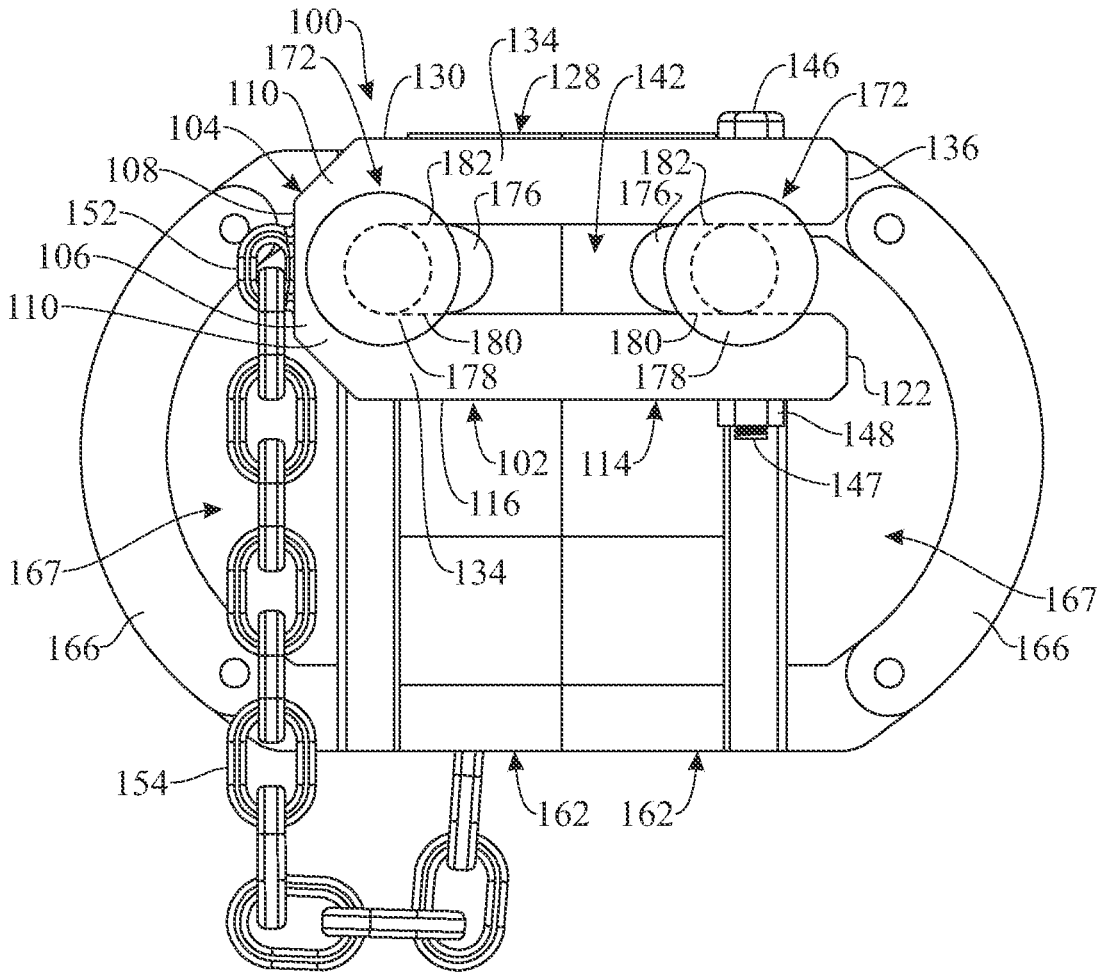
FIG. 7 presents a front elevation view of the locking clamp assembly deployed in place on the closed tubular elevator.

As illustrated in FIGS. 1 and 2, in some embodiments, the locking clamp 102 may include a generally rigid clamp body, hereinafter referred to as main body 104. The main body 104 includes a pair of spaced-apart arms 114, 128 extending in spaced apart relationship with one another, with the clamp space 142 formed by and between the arms 114, 128. In some embodiments, the pair of spaced-apart arms 114, 128 may include a first or lower arm 114 and a second or upper arm 128. The lower arm 114 and upper arm 128 may be straight, and further optionally parallel to one another, as shown. The locking clamp 102 may be deployed on the tubular elevator 160 such that the upper arm 128 is positioned above the lower arm 114, as illustrated in FIG. 7. In some embodiments, the main body 104 may include a side portion 106. In some embodiments, the lower arm 114 and the upper arm 128 may extend from opposite ends 110 of the side portion 106. For instance, the side portion 106 and arms 114, 128 may form a C-shaped or U-shaped arrangement, as shown, where the C-shaped arrangement includes a closed end 105*a* at the side portion 106, and an opposite, open end 105*b* at the free ends of the upper and lower arms 128 and 114. In some embodiments, the C-shaped main body 104 may be generally elongated, with the upper and lower arms 128 and 114 longer than the side portion 106, as shown; for example, in the present embodiment, the upper and lower arms 128 and 114 are about twice as long as the side portion 106. In some embodiments, the ends 110 of the side portion 106 may be chamfered (an example of which is shown in the drawings), rounded, or present other alternative shapes lacking sharp edges.

At least one clamp fastener 146 may be selectively deployable to retain the structural elements 172 on the tubular elevator 160 within the clamp space 142. In some embodiments, the clamp fastener 146 may include a threaded bolt 147 and a securing nut 148. The clamp fastener 146 may extend through registering fastener openings 150 (FIG. 4) in the respective lower arm 114 and upper arm 128 at opposite sides of the clamp space 142, such that extending the threaded bolt 147 through the openings 150 allows the bolt 147 to span (i.e. extend across) the clamp space 142, from the upper arm 128 to the lower arm 114, closing the open end 105*b* of the C-shaped main body 104. In some embodiments, such as the present embodiment, the fastener openings 150 and the clamp fastener 146 may be configured such that the fastener 146 is arranged parallel to the side portion 106 of the main body 104 of the locking clamp 102 when the fastener 146 is being inserted (and once inserted) into the fastener openings 150; in this way, the side portion 106 may serve as a visual indicator on how to orient the fastener 146 to properly insert the fastener 146 through the fastener openings 150 during assembly, thereby facilitating a more rapid and direct attachment of the fastener 146 to the main body 104. In some embodiments, the clamp fastener 146 may include additional or alternative fastening devices known by those skilled in the art (e.g., a bayonet fastener, a frictionally-fitting fastener, etc.).

With continued reference to FIGS. 1 and 2, at least one tether 154 may attach the locking clamp 102 to the tubular elevator 160. The tether 154 may include any structural element or combination of structural elements having a sufficient strength and flexibility suitable for the purpose. The tether 154 is preferably flexible and non-stretchable. For example and without limitation, in some embodiments, the tether 154 may include a chain or cable.

The at least one tether 154 may be attached to the main body 104. In some embodiments, more specifically, the at least one tether 154 may be attached to the side portion 106 of the main body 104. The main body 104 of the locking clamp 102 may have a tether attachment surface 108, and the at least one tether 154 may be attached to the tether attachment surface 108. In some embodiments, at least one tether attachment structure 152 may be provided on the tether attachment surface 108, and the tether 154 may be attached to the tether attachment structure 152. For instance and without limitation, the tether attachment structure 152 may include a ring, a hook, a loop, a C-shaped protrusion (as shown), a U-shaped protrusion, a D-ring, or the like. In other embodiments, the tether attachment structure 152 may be welded and/or otherwise permanently attached to the tether attachment surface 108 according to the knowledge of those skilled in the art. In other embodiments, the tether 154 may be welded and/or otherwise attached to the tether attachment surface 108 according to the knowledge of those skilled in the art. In preferred embodiments, the tether 154 may be permanently or non-disconnectably attached to the main body 104; for instance, in the depicted embodiment, the tether 154 is non-disconnectably engaged with the tether attachment structure 152.

As further shown in FIGS. 1 and 2, in some embodiments, each of the lower arm 114 and the upper arm 126 may have a square or rectangular cross-section. The lower arm 114 may have an outer surface 116. An inner surface 118 may extend in parallel, spaced-apart relationship to the outer surface 116. The inner surface 118 may face the clamp space 142. A pair of side surfaces 120 may extend from the outer surface 116 to the inner surface 118 on a front and a rear side, respectively, of the lower arm 114. A terminal surface 122 may terminate the lower arm 114 at the open end 105*b* of the C-shaped main body 104. In some embodiments, a pair of terminal arm bevels 124 may extend between the terminal surface 122 and the respective outer surface 116 and inner surface 118 of the lower arm 114.

The upper arm 128 may have an outer surface 130. An inner surface 132 may extend in parallel, spaced-apart relationship to the outer surface 130. The inner surface 132 may face the clamp space 142. A pair of side surfaces 134 may extend from the outer surface 130 to the inner surface 132 on a front and a rear side, respectively, of the upper arm 128. A terminal surface 136 may terminate the upper arm 128 at the open end 105*b* of the C-shaped main body 104. In some embodiments, a pair of terminal arm bevels 138 may extend between the terminal surface 136 and the respective outer surface 130 and inner surface 132 of the upper arm 128.

Figure 6:
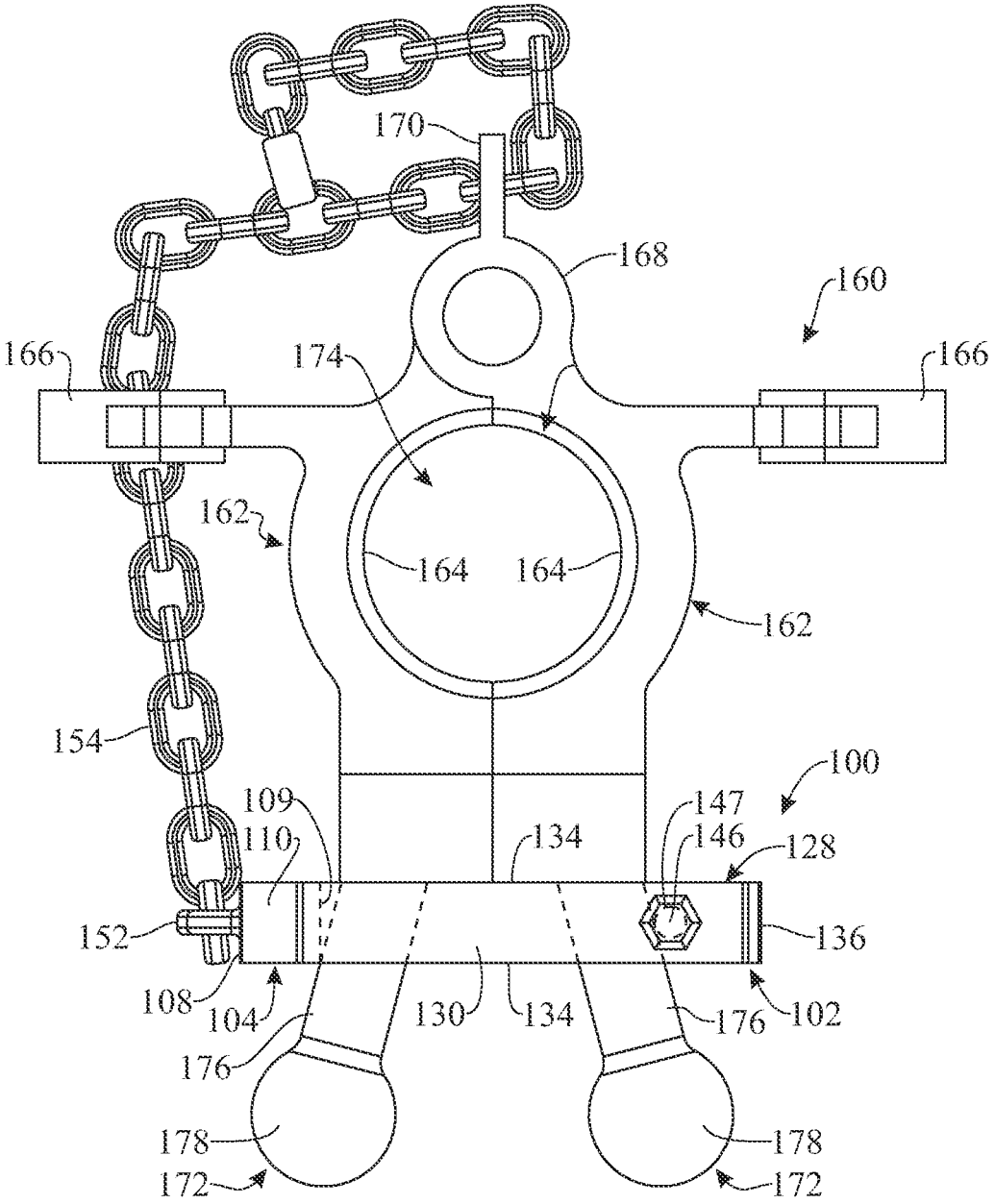
FIG. 6 presents a top plan view of the locking clamp assembly deployed in place on the closed tubular elevator.

As described heretofore, the tether 154 may secure the main body 104 of the locking clamp 102 to the tubular elevator 160. To secure the tether 154 to the tubular elevator 160, the tether 154 may be attached to any structural component or element of the tubular elevator 160. For instance and without limitation, as shown in FIG. 6, in some applications, the tether 154 may be attached to the rear arm 170 that extends from the elevator hinge 168. In some cases, the tether 154 may be arranged to extend from the tether attachment structure 152 on the locking clamp 102 and through the interior space 167 formed between one of the side arms 166 and its corresponding jaw 162; extending the tether 154 through the interior space 167 defined by a side arm 166 may provide increased security to the retaining effect granted by the tether 154 on the main body 104, should the main body 104 accidentally disconnect and fall from the tubular elevator 160.

The illustrations of FIGS. 3-7 demonstrate an example of application of the locking clamp assembly 100 in accordance with the present disclosure. In this example, a tubular element 200, shown schematically and in phantom lines in FIG. 4, is secured in the tubular elevator 160 during assembly and disassembly of the tubular element. For this purpose, the tubular elevator 160 may initially be deployed in the open configuration illustrated in FIG. 3 by pivoting the jaws 162 outwardly via the elevator hinge 168. The tubular element 200 may then be placed between the tubular element engaging surfaces 164, and the jaws 162 may be closed (FIG. 4) such that the tubular element 200 extends through the tubular element bore 174 formed by the tubular element engaging surfaces 164.

As illustrated in FIG. 4, the locking clamp 102 may be oriented such that the upper arm 128 is arranged above, and in vertical registration with, the lower arm 114 of the locking clamp 102. The locking clamp 102 may be deployed in place by aligning the clamp space 142 with the structural elements 172 on the tubular elevator 160 and fitting the open end 105*b* of the main body 104 of the locking clamp 102 over the structural elements 172 until the structural elements 172 are disposed in the clamp space 142, as illustrated in FIG. 5. The clamp fastener 146 may then be secured to the locking clamp 102 by inserting the bolt 147 through the fastener openings 150 in the respective lower arm 114 and upper arm 128 and then threading the nut 148 to a threaded end of the bolt 147 which protrudes outward (downward) of the lower arm 114. With the clamp fastener 146 secured in place, as shown in FIGS. 5-7, the clamp fastener 146 closes the open end 105*b* of the main body 104 of the locking clamp 102, and the elongated arms 176 remain inside the clamp space 172 and abut against an inner side 109 of the side portion 106, opposite the tether attachment surface 108, and against the bolt 147 of the clamp fastener 146. Thus, the locking clamp 102 secures and locks the jaws 162 of the tubular elevator 160 in the closed configuration as the tubular element remains secured in the tubular element bore 174. This expedient ensures the safety of drilling personnel throughout assembly and disassembly of the tubular element.

In some embodiments, such as the present embodiment, the width of the clamp space 142 (i.e. the separation between the upper and lower arms 128 and 114) generally matches the thickness or width (e.g., diameter) of the respective elongated arm 176 of each structural element 172 such that the inner surfaces 132 and 118 may tightly contact the elongated arms 176 of the structural elements 172 creating a relatively high friction therebetween that contributes to secure the locking clamp 102 in a fixed position relative to the structural elements 172 when the clamp fastener 146 is tightened or otherwise secured. In some embodiments, as best shown in FIG. 7, the inner surface 118 of the lower arm 114 may be generally planar and configured to rest on and along a bottom contact edge of each one of the structural elements 172 such that both bottom contact lines or edges 180 form a contact plane which stabilizes the lower arm 114 against the structural elements 172 in a front-to-back direction. Similarly, the inner surface 132 of the upper arm 128 may be generally planar and configured to rest on and along a top contact edge of each one of the structural elements 172 such that both upper contact lines or edges 182 form a contact plane which stabilizes the lower arm 114 against the structural elements 172 in the front-to-back direction. Alternatively or additionally, the width of the clamp space 142 (i.e. the separation between the upper and lower arms 128 and 114) may be less than the thickness or width (e.g., diameter) of the respective head 178 of each structural element 172 such that a forward movement of the main body 104 relative to the structural elements 172 is blocked by the front side surfaces 120 and 134 of the lower and upper arms 114 and 128, respectively, abut against the heads 178. In some embodiments, the generally rigid main body 104 may be slightly, and preferably elastically, flexible to increase said contact between the inner surfaces 132 and 118 and the structural elements 172 when the clamp fastener 146 is tightened or otherwise secured.

When no longer in use, the locking clamp assembly 100 may be easily disconnected from the tubular elevator 160 and the tubular elevator 160 in turn removed from the tubular element. For this purpose, the nut 148 is unthreaded from the bolt 147, and the clamp fastener 146 is extracted from the fastener openings 150. The locking clamp 102 is then separated from the structural elements 172 by sliding the structural elements 172 out through the open end 105*b* of the main body 104 of the locking clamp 102. Once the structural elements 172 are released from the locking clamp 102, the structural elements 172 are freed to rotate about the elevator hinge 168. The structural elements 172 may then be pivoted about the elevator hinge 168, and the tubular elevator 160 may be deployed from the closed configuration (FIG. 4) to the open configuration (FIG. 3). With the tubular elevator 160 in the open configuration, the tubular element 200 may be removed from between the jaws 162 and the tubular elevator 160 deployed on another tubular element.

The tether 154 may ensure that the locking clamp 102 remains attached to the tubular elevator 160 at all times, regardless of whether the tubular elevator 160 is arranged in the open or closed configuration. This facilitates maintaining the locking clamp 102 readily available for use for each deployment of the tubular elevator 160 on the tubular element 200. In addition, the tethering of the locking clamp 102 to the tubular elevator 160 prevents the locking clamp 102, if accidentally falling from the tubular elevator 160 during installation or removal of the locking clamp 102, from injuring any nearby worker or equipment.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A locking clamp and tubular elevator assembly, comprising:

a tubular elevator, comprising a pair of jaws movable relative to one another between an open position and a closed position for receiving and retaining a tubular element, respectively, the tubular elevator further comprising a pair of structural elements, each structural element extending from a respective jaw of the pair of jaws; and a locking clamp assembly, comprising:

a locking clamp, including a main body comprising a side portion, a first arm, and a second arm, the first and second arms extending from the side portion in spaced-apart relationship with one another, and at least one clamp fastener connectable to the locking clamp; wherein the locking clamp and tubular elevator assembly is positionable in an assembled configuration, in which:

the pair of jaws are arranged in the closed position and the main body of the locking clamp is mounted on the pair of structural elements, the at least one clamp fastener is connected to the locking clamp, a clamp space being defined by and between the side portion, the first arm, the second arm and the at least one clamp fastener, the clamp space extending uninterruptedly from the side portion to the at least one clamp fastener, the clamp space defined by a planar inner surface of the first arm and a planar inner surface of the second arm, the planar inner surfaces of the first and second arms arranged parallel to one another and extending from the side portion to the at least one clamp fastener, and further in which the pair of structural elements are received within the clamp space, with the clamp body and at least one clamp fastener retaining the pair of structural elements within the clamp space and further retaining the pair of jaws in the closed position.

2. The locking clamp and tubular elevator assembly of claim 1, wherein each structural element of the pair of structural elements comprises a respective head, wherein, in the assembled configuration, the main body of the locking clamp is retained on the pair of structural elements and the pair of structural elements are retained within the clamp space by the heads of the pair of structural elements.

3. The locking clamp and tubular elevator assembly of claim 2, wherein the clamp space is less wide than the heads of the pair of structural elements.

4. The locking clamp and tubular elevator assembly of claim 1, wherein, in the assembled configuration, the first arm is arranged below the pair of structural elements and the second arm is arranged above the pair of structural elements.

5. The locking clamp and tubular elevator assembly of claim 1, wherein a distance between the first and second arms is generally equal to a thickness of a respective portion of each structural element of the pair of structural elements received between the first and second arms, and further wherein, in the assembled configuration, the first and second arms abut against the respective portions of the pair of structural elements.

6. The locking clamp and tubular elevator assembly of claim 5, wherein, in the assembled configuration, the first arm contacts the respective portions of the pair of structural elements along respective first contact edges forming a first contact plane, and the second arm contacts the respective portions of the pair of structural elements along respective second contact edges forming a second contact plane.

7. The locking clamp and tubular elevator assembly of claim 1, wherein the first and second arms extend from opposite ends of the side portion of the main body.

8. The locking clamp and tubular elevator assembly of claim 1, wherein the side portion and first and second arms form a C-shaped arrangement comprising a closed end and an opposite, open end.

9. The locking clamp and tubular elevator assembly of claim 8, wherein the at least one clamp fastener comprises an end fastener securable to the main body, wherein, in the assembled configuration, the end fastener is secured to the main body at or near the open end thereof, retaining the pair of structural elements within the clamp space.

10. The locking clamp and tubular elevator assembly of claim 9, wherein, in the assembled configuration, the pair of structural elements abuts against an inner side of the side portion facing the clamp space and further against the end fastener.

11. The locking clamp and tubular elevator assembly of claim 9, wherein, in the assembled configuration, the end fastener extends from the first arm to the second arm.

12. The locking clamp and tubular elevator assembly of claim 11, wherein each one of the first and second arms includes a respective fastener opening, the fastener openings of the first and second arms configured to receive the end fastener therethrough in a direction parallel to the side portion.

13. The locking clamp and tubular elevator assembly of claim 1, further comprising at least one tether mountable to connect the locking clamp assembly to the tubular elevator, wherein, in the assembled configuration, the at least one tether attaches the locking clamp assembly to the tubular elevator.

14. The locking clamp and tubular elevator assembly of claim 13, wherein, in the assembled configuration, the at least one tether is attached to the main body of the locking clamp of the locking clamp assembly.

15. The locking clamp and tubular elevator assembly of claim 13, wherein the locking clamp and tubular elevator assembly is alternatively and selectively positionable in a released configuration, in which the at least one clamp fastener is at least partially disconnected from the locking clamp and the pair of structural elements are removed from the clamp space allowing the pair of jaws to move towards the open position, and further in which the locking clamp assembly is secured to the tubular elevator by the at least one tether.

16. The locking clamp and tubular elevator assembly of claim 13, wherein, in the assembled configuration, the at least one tether is attached to the side portion of the main body, the side portion opposite to an open end of the main body through which the pair of structural elements are insertable into and removable from the clamp space.

17. The locking clamp and tubular elevator assembly of claim 16, wherein the at least one tether is attached to a tether attachment surface of the main body, the tether attachment surface arranged opposite to the clamp space.

18. A locking clamp and tubular elevator assembly, comprising:

a tubular elevator, comprising a pair of jaws movable relative to one another between an open position and a closed position for receiving and retaining a tubular element, respectively, the tubular elevator further comprising a pair of structural elements, each structural element extending from a respective jaw of the pair of jaws; and a locking clamp assembly, comprising:

a locking clamp, including a generally rigid main body, the main body comprising a side portion, a first arm, and a second arm, the first and second arms extending from the side portion in spaced-apart relationship with one another, and at least one clamp fastener connectable to the locking clamp; wherein the locking clamp and tubular elevator assembly is positionable in an assembled configuration, in which:

the pair of jaws are arranged in the closed position and the main body of the locking clamp is mounted on the pair of structural elements, the at least one clamp fastener is connected to the locking clamp, a clamp space being defined by and between the side portion, the first arm, the second arm and the at least one clamp fastener, the clamp space extending uninterruptedly from the side portion to the at least one clamp fastener, the clamp space defined by a planar inner surface of the first arm and a planar inner surface of the second arm, the planar inner surfaces of the first and second arms arranged parallel to one another and extending from the side portion to the at least one clamp fastener, and further in which the pair of structural elements are received within the clamp space and abut against the first arm, the second arm, the side portion, and the fastener, with the clamp body and at least one clamp fastener retaining the pair of structural elements within the clamp space and further retaining the pair of jaws in the closed position.

19. A locking clamp and tubular elevator assembly, comprising:

a tubular elevator, comprising a pair of jaws movable relative to one another between an open position and a closed position for receiving and retaining a tubular element, respectively, the tubular elevator further comprising a pair of structural elements, each structural element extending from a respective jaw of the pair of jaws; and a locking clamp assembly, comprising:

a locking clamp, including a generally rigid main body, the main body comprising a side portion, a first arm, and a second arm, the first and second arms extending from the side portion in spaced-apart relationship with one another forming a C-shaped arrangement with the side portion, and at least one clamp fastener connectable to the locking clamp; wherein the locking clamp and tubular elevator assembly is positionable in an assembled configuration, in which:

the pair of jaws are arranged in the closed position and the main body of the locking clamp is mounted on the pair of structural elements, the at least one clamp fastener is connected to the locking clamp, a clamp space being defined by and between the side portion, the first arm, the second arm and the at least one clamp fastener, the clamp space extending uninterruptedly from the side portion to the at least one clamp fastener, the clamp space defined by a planar inner surface of the first arm and a planar inner surface of the second arm, the planar inner surfaces of the first and second arms arranged parallel to one another and extending from the side portion to the at least one clamp fastener, and further in which the pair of structural elements are received within the clamp space and abut against the first arm, the second arm, the side portion, and the fastener, with the clamp body and at least one clamp fastener retaining the pair of structural elements within the clamp space and further retaining the pair of jaws in the closed position.

* * * * *